US008310427B2

(12) United States Patent
Sheu

(10) Patent No.: US 8,310,427 B2
(45) Date of Patent: Nov. 13, 2012

(54) LIQUID CRYSTAL DISPLAY HAVING COMMON VOLTAGE REGENERATOR AND DRIVING METHOD THEREOF

(75) Inventor: Yi-Zhong Sheu, Miao-Li (TW)

(73) Assignee: Chimei Innolux Corporation, Miaoli County (TW)

( * ) Notice: Subject to any disclaimer, the term of this patent is extended or adjusted under 35 U.S.C. 154(b) by 697 days.

(21) Appl. No.: 12/218,362

(22) Filed: Jul. 14, 2008

(65) Prior Publication Data

US 2009/0015528 A1 Jan. 15, 2009

(30) Foreign Application Priority Data

Jul. 13, 2007 (CN) ..... 2007 1 0076014

(51) Int. Cl.
*G09G 3/36* (2006.01)

(52) U.S. Cl. ..... 345/92

(58) Field of Classification Search ..... 345/92
See application file for complete search history.

(56) References Cited

U.S. PATENT DOCUMENTS 6,831,627 B2 * 12/2004 Hasegawa et al. ..... 345/102
7,102,604 B2 9/2006 Hong
7,508,385 B2 * 3/2009 Ueda et al. ..... 345/204
7,542,021 B2 * 6/2009 Kim et al. ..... 345/98
7,839,478 B2 * 11/2010 Lee et al. ..... 349/149
7,859,496 B2 * 12/2010 Kim et al. ..... 345/87
7,893,907 B2 * 2/2011 Kang ..... 345/94
2002/0154086 A1 * 10/2002 Furuhashi et al. ..... 345/100
2006/0170640 A1 * 8/2006 Okuno ..... 345/98
2006/0244704 A1 * 11/2006 JaeHun ..... 345/92
2007/0002005 A1 * 1/2007 Kim et al. ..... 345/103
2007/0024560 A1 * 2/2007 Kim et al. ..... 345/94
2007/0296674 A1 * 12/2007 Aoki et al. ..... 345/94

* cited by examiner

*Primary Examiner* — Chanh Nguyen
*Assistant Examiner* — Roy Rabindranath
(74) *Attorney, Agent, or Firm* — Muncy, Geissler, Olds & Lowe, PLLC

(57) ABSTRACT

An exemplary liquid crystal display includes a liquid crystal panel, a common voltage generator, and a common voltage regenerator. The liquid crystal panel includes liquid crystal capacitors and storage capacitors. Each liquid crystal capacitor includes a common electrode. Each storage capacitor includes a storage electrode. The common voltage generator is configured to provide a common voltage to the storage electrode. The common voltage regenerator is configured to receive a common feedback voltage from the storage electrode, generate a common regenerative voltage according to the common feedback voltage, and provide the common regenerative voltage to the common electrode.

16 Claims, 5 Drawing Sheets

LIQUID CRYSTAL DISPLAY HAVING COMMON VOLTAGE REGENERATOR AND DRIVING METHOD THEREOF

CROSS-REFERENCE TO RELATED APPLICATION

This application is related to, and claims the benefit of, a foreign priority application filed in China as Serial No. 200710076014.1 on Jul. 13, 2007. The related application is incorporated herein by reference.

BACKGROUND

1. Field of the Invention

The present invention relates to liquid crystal displays, and more specifically to a liquid crystal display including a common voltage regenerator, and to a driving method thereof.

2. General Background

Liquid crystal displays (LCD) display a clear and sharp image through thousands or even millions of individual pixels. The liquid crystal display has thus been applied to various electronic devices, such as mobile phones and notebook computers.

FIG. 5 is an abbreviated circuit diagram of a typical liquid crystal display 10. The liquid crystal display 10 includes a liquid crystal panel 11, a gate driving circuit 13, a data driving circuit 14, and a common voltage generator 15. The gate driving circuit 13 and the data driving circuit 14 drive the liquid crystal panel 11. The common voltage generator 15 provides a common voltage for the liquid crystal panel 11.

The liquid crystal panel 111 includes a plurality of parallel gate lines 131, each extending along a first axis, a plurality of parallel data lines 141 extending along a second axis orthogonal to the first axis, and a common line 101. The intersecting gate lines 131 and data lines 141 define an array of pixel units 102.

Each pixel unit 102 includes a thin film transistor (TFT) 1021 provided in the vicinity of a point of intersection of a gate line 131 and data line 141, a liquid crystal capacitor 1022, and a storage capacitor 1023. The liquid crystal capacitor 1022 includes a pixel electrode 1025, a common electrode 1026 facing the pixel electrode 1025, and a liquid crystal layer (not shown) sandwiched therebetween. Each storage capacitor 1023 includes the pixel electrode 1025, a storage electrode 1027, and insulating material sandwiched therebetween. A gate electrode, a source electrode, and a drain electrode of the TFT 1021 are connected to a corresponding gate line 131, a corresponding data line 141, and the pixel electrode 1025 respectively.

When the liquid crystal display 10 functions normally, the gate driving circuit 13 provides a plurality of scanning signals to the gate lines 131 in sequence, such that the TFTs 1021 connected to the gate lines 131 are switched on. At the same time, the data driving circuit 14 provides a plurality of gradation voltages to the data lines 141. The gradation voltages are applied to the pixel electrodes 1025 via the source and drain electrodes of the activated TFTs 1021. The common voltage generator 15 generates a common voltage, and provides the common voltage to the common electrode 1026 and the storage electrode 1027 via the common line 101. The common voltage is generally a 5v direct current (DC) voltage.

However, the common voltage of the liquid crystal display 10 susceptible to influence by a variety of coupling capacitances. As a result, ripples in the common voltage occur, resulting in crosstalk, whereby display quality of the liquid crystal display 10 is impaired.

Therefore, a liquid crystal display that can overcome the limitations described is desired.

SUMMARY

In one preferred embodiment, a liquid crystal display includes a liquid crystal panel, a common voltage generator, and a common voltage regenerator. The liquid crystal panel includes a plurality of liquid crystal capacitors and a plurality of storage capacitors. Each liquid crystal capacitor includes a common electrode. Each storage capacitor includes a storage electrode. The common voltage generator is configured to provide a common voltage to the storage electrode. The common voltage regenerator is configured to receive a common feedback voltage from the storage electrode, generate a common regenerative voltage according to the common feedback voltage, and provide the common regenerative voltage to the common electrode.

Other novel features and advantages will become more apparent from the following detailed description when taken in conjunction with the accompanying drawings.

DETAILED DESCRIPTION OF PREFERRED EMBODIMENTS

Figure 1:
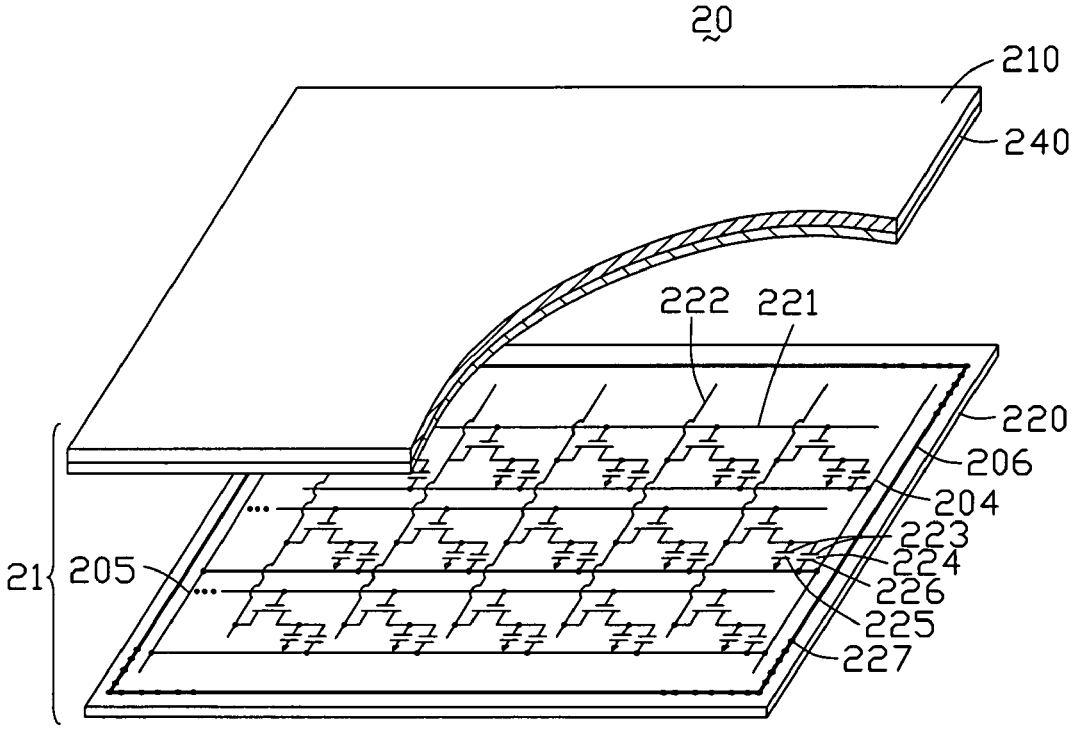
FIG. 1 is an exploded, isometric view of a liquid crystal display according to a first embodiment of the present invention.

Referring to FIG. 1, a liquid crystal display 20 according to a first embodiment of the present invention is shown. The liquid crystal display 20 includes a liquid crystal panel 21 and a backlight module (not shown). The liquid crystal panel 21 includes a first glass substrate 210, a second glass substrate 220 parallel to the first substrate 210, and a liquid crystal layer (not shown) sandwiched therebetween.

A common electrode 240 is formed on a surface of the first substrate 210 adjacent to the liquid crystal layer. A first common voltage line 204, a second common voltage line 205, a common voltage 206, a plurality of gate lines 221 and a plurality of data lines 222 are formed on a surface of the second substrate adjacent to the liquid crystal layer. The plurality of gate lines 221 are parallel to each other and each extend along a first axis. The plurality of data lines 222 are parallel to each other and each extend along a second axis orthogonal to the first axis. The crossed gate lines 221 and data lines 222 define an array of pixel units of the liquid crystal panel 21. Each pixel unit includes a liquid crystal capacitor 225 and a storage capacitor 224. The liquid crystal capacitor 225 includes a pixel electrode 223, the common electrode 240, and the liquid crystal layer sandwiched therebetween. The storage capacitor 224 includes the pixel electrode 223, a storage electrode 226, and insulating material sandwiched therebetween.

The first and second common voltage lines 204, 205 are formed at two opposite edges of the second substrate 220, parallel to the data lines 222. The first and second common voltage lines 204, 205 are connected to the storage electrodes 226 via internal wires (not labeled).

The common lines 206 are formed along four edges of the second substrate 220 forming a rectangle, and are connected with the common electrode 240 via silver paste 227 on four corners of the second substrate 220.

Figure 2:
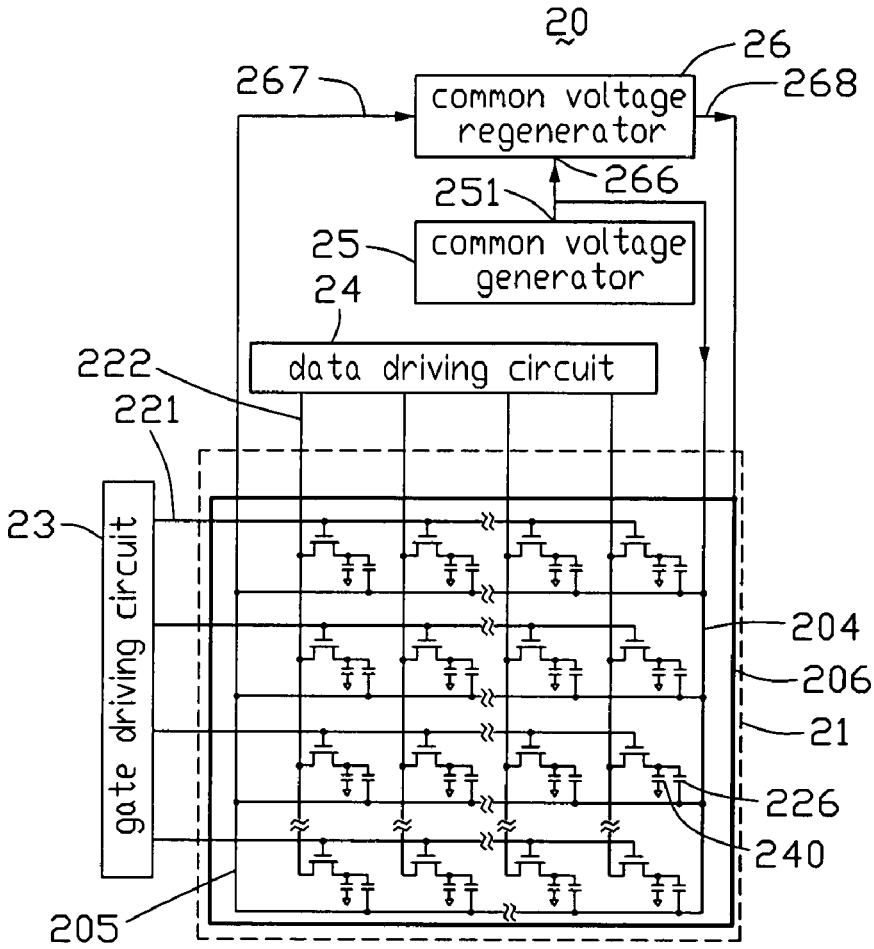
FIG. 2 is an abbreviated circuit diagram of the liquid crystal display of FIG. 1, the liquid crystal display including a common voltage regenerator.

Referring also to FIG. 2, the liquid crystal display 20 further includes a gate driving circuit 23, a data driving circuit 24, a common voltage generator 25, and a common voltage regenerator 26.

The gate driving circuit 23 provides a plurality of scanning signals to the gate lines 221. The data driving circuit 24 provides a plurality of gradation voltages to the data lines 222.

The common voltage generator 25 includes a common voltage output 251. The common voltage output 251 is configured to provide a common voltage to the storage electrode 226 via the first common voltage line 204. In the illustrated embodiment, the common voltage is a 5v DC voltage.

The common voltage regenerator 26 includes a common voltage input 266, a common feedback voltage input 267, and a common regenerative voltage output 268. The common feedback voltage input 267 is electrically connected to the second common voltage line 205, and is configured to receive a common feedback voltage from the storage electrode 226 via the second common voltage line 205. The common voltage input 266 is electrically connected to the common voltage output 251 of the common voltage generator 25. The common regenerative voltage output 268 is electrically connected to the common line 206, and is configured to provide a common regenerative voltage to the common electrode 240 via the common line 206 and the silver paste 227.

Figure 3:
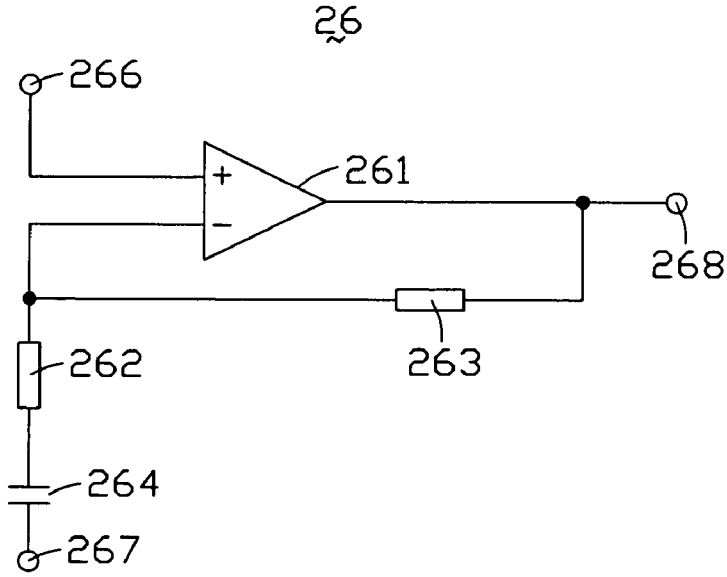
FIG. 3 is essentially a circuit diagram of the common voltage regenerator of FIG. 2.

Referring also to FIG. 3, the common voltage regenerator 26 further includes an operational amplifier 261, a first resistor 262, a second resistor 263, and a capacitor 264. The common feedback voltage input 267 is electrically connected to an inverting input of the operational amplifier 261 via the capacitor 264 and the first resistor 262. An output of the operational amplifier 261 is electrically connected to the common regenerative voltage output 268 of the common voltage regenerator 26. The common regenerative voltage output 268 of the common voltage regenerator 26 is also electrically connected to the inverted input of the operational amplifier 261 via the second resistor 263. The common voltage input 266 is electrically connected to a non-inverting input of the operational amplifier 261.

A method for driving the liquid crystal display 20 is as follows:

When the liquid crystal display 20 functions normally, the common voltage output 251 of the common voltage generator 25 provides a 5v DC voltage to the non-inverting input of the operational amplifier 261 through the common voltage input 266 of the common voltage regenerator 26, and a 5v DC voltage to the storage electrode 226 via the first common voltage line 204. The common feedback voltage input 267 receives a common feedback voltage from the storage electrode 226 via the second common voltage line 205. The common feedback voltage has ripples which occur under action of all kinds of coupling capacitances in the liquid crystal panel 21. The common feedback voltage is applied to the inverting input of the operational amplifier 261 via the capacitor 264 and the first resistor 262. The operational amplifier 261 operates according to the common voltage received through the non-inverting input and the common feedback voltage received through the inverting input, and outputs a common regenerative voltage through the common regenerative voltage output 268. The common regenerative voltage has ripples having a phase opposite to those of the common feedback voltage. The common regenerative voltage is applied to the common electrode 240 via the common line 206 and the silver paste 227. While the common regenerative voltage is transmitted in the liquid crystal panel 21, the ripples thereof are mitigated or even eliminated by the action of the coupling capacitances. Thus, the common electrode 240 is applied with a 5v DC voltage with few or no ripples.

Resistances of the first and second resistors 262, 263 can be adjusted according to different amplitudes of the ripples, in order that amplitude of the ripples of the common regenerative voltage is the same as that of the ripples of the common feedback voltage.

In summary, the liquid crystal display 20 includes the common voltage regenerator 26 configured to receive the common feedback voltage having the ripples and provide a common rippled regenerative voltage to the common electrode 240, the ripples of which have the same amplitude as those of the common feedback voltage, and phase opposite to those of the common feedback voltage. Thus, ripples of the common voltage are mitigated or even eliminated by the action of the coupling capacitances, and the common electrode 240 receives a 5v DC voltage with fewer or even no ripples. The liquid crystal display 20 thus provides satisfactory display quality.

Figure 4:
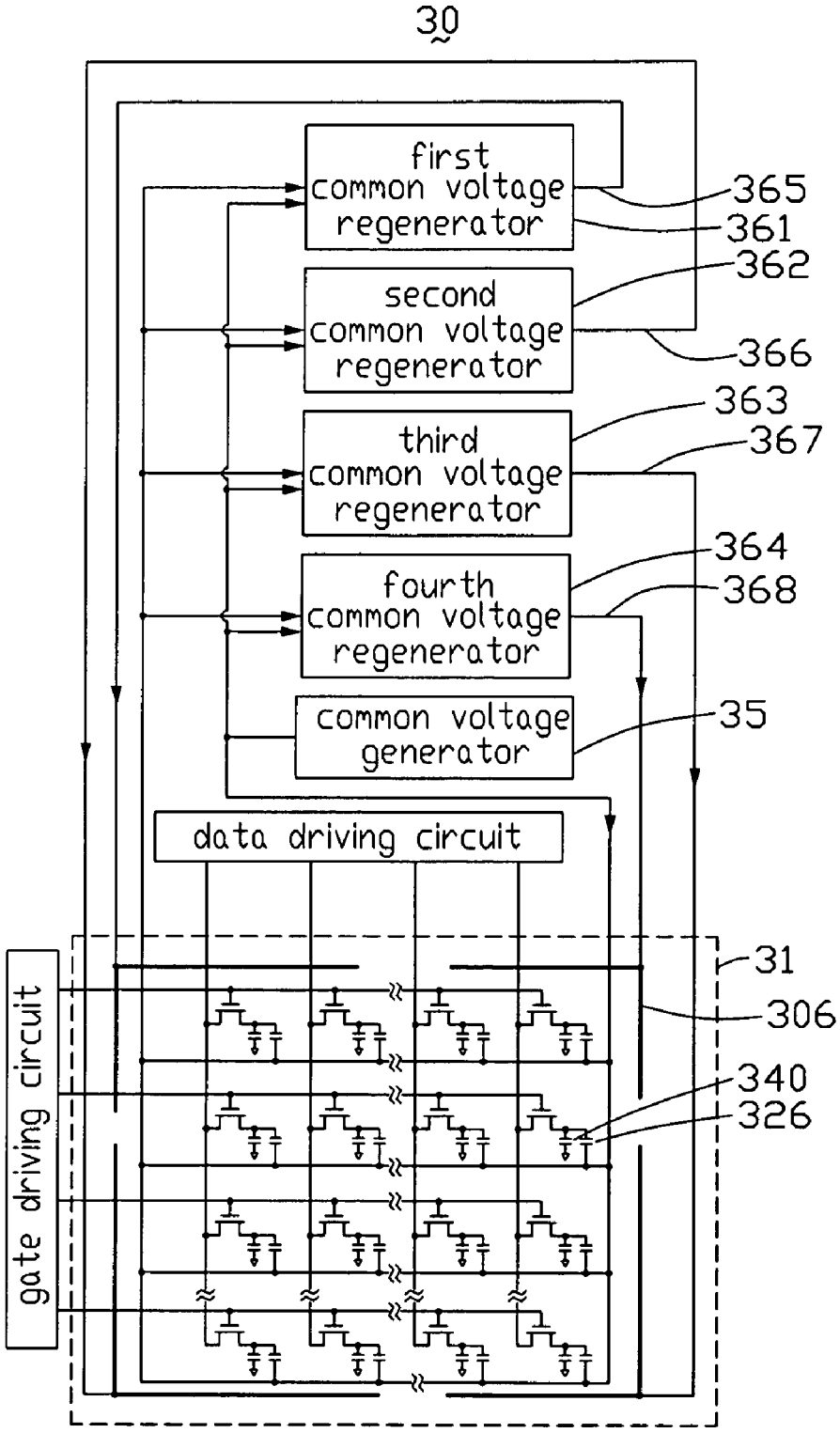
FIG. 4 is an abbreviated circuit diagram of a liquid crystal display according to a second embodiment of the present invention.
Figure 5:
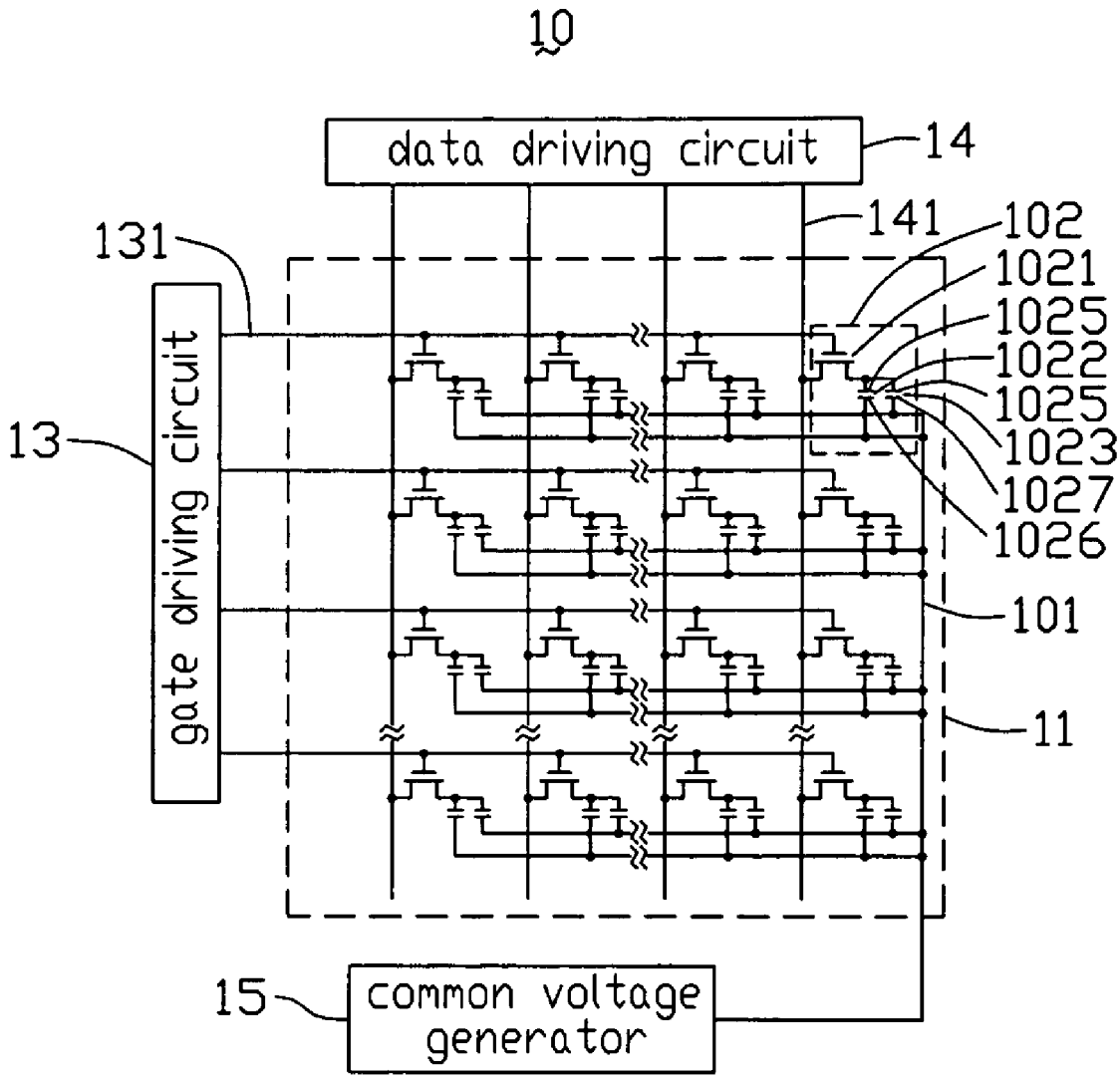
FIG. 5 (RELATED ART)
FIG. 5 is an abbreviated circuit diagram of a conventional liquid crystal display.
Figure 6:
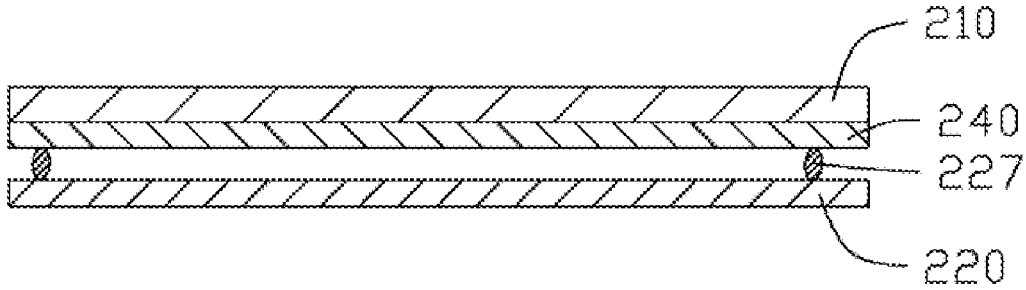
FIG. 6 is a cross-sectional isometric view of an assembly of the liquid crystal display of FIG. 1.

Referring to FIG. 4, a liquid crystal display 30 according to a second embodiment of the present invention is similar to the liquid crystal display 20 of the first embodiment, differing only in the inclusion of a first common voltage regenerator 361 having a first common regenerative voltage output 365, a second common voltage regenerator 362 having a second common regenerative voltage output 366, a third common voltage regenerator 363 having a third common regenerative voltage output 367, and a fourth common voltage regenerator 364 having a fourth common regenerative voltage output 368. The four common voltage regenerators 361, 362, 363, 364 receive the same common feedback voltage. The four common voltage regenerators 361, 362, 363, 364 include first resistors having different resistances and second resistors having different resistances, and thereby output different common regenerative voltages. Moreover, a common line 306 of the liquid crystal display 30 is divided into four separate sections, connected to silver paste located on four corners of a liquid crystal panel 31 of the liquid crystal display 30, respectively.

The four common voltage regenerators 361, 362, 363, 364 provide the different common regenerative voltages to the fourth sections of the common line 306, respectively, to provide the different common regenerative voltages to different sections of a common electrode 340 of the liquid crystal panel 31. Because coupling capacitances in different regions of the liquid crystal panel 31 are different, the different common regenerative voltages corresponding to the different regions of the liquid crystal panel 31 can be mitigated, respectively.

A method for driving the liquid crystal display 30 is as follows:

When the liquid crystal display 30 functions normally, a common voltage generator 35 provides a 5v DC voltage to the four common voltage regenerators 361, 362, 363, 364 respectively, and a 5v DC voltage to a storage electrode 326. The four common voltage regenerators 361, 362, 363, 364 each receive a common feedback voltage from the storage electrode 326. The common feedback voltages each have ripples which occur under action of all kinds of coupling capacitances in the liquid crystal panel 31. The four common voltage regenerators 361, 362, 363, 364 output four common regenerative voltages to different sections of the common electrode 340 via the fourth sections of the common line 306, respectively. The common regenerative voltages each have ripples having a phase opposite to those of the corresponding common feedback voltage. While the common regenerative voltages are transmitted in the liquid crystal panel 31, the ripples thereof are mitigated or even eliminated by the action of the coupling capacitances. Thus, the different sections of the common electrode 340 are applied with a 5v DC voltage with few or no ripples.

It is to be further understood that even though numerous characteristics and advantages of the present embodiments have been set out in the foregoing description, together with details of the structures and functions of the embodiments, the disclosure is illustrative only; and that changes may be made in detail, especially in matters of shape, size and arrangement of parts within the principles of the invention to the full extent indicated by the broad general meaning of the terms in which the appended claims are expressed.

What is claimed is:

1. A liquid crystal display comprising:

a liquid crystal panel comprising:

a first substrate including a common electrode layer formed thereon;

a second substrate opposite to the first substrate; and a liquid crystal layer sandwiched between the first and second substrates;

a plurality of data lines and a plurality of gate lines provided on the second substrate and crossing each other to define a plurality of pixel units, each pixel unit comprising a liquid crystal capacitor, and a storage capacitor, each liquid crystal capacitor comprising a pixel electrode for receiving gradation voltages applied by a corresponding one of the data lines, the common electrode layer opposite to the pixel electrode and the liquid crystal layer sandwiched therebetween; and each storage capacitor comprising the pixel electrode, a storage electrode opposite to the pixel electrode and an insulating material sandwiched therebetween; and a first common voltage line and a second common voltage line formed at two opposite sides of the second substrate for sandwiching the plurality of pixel units, both of the first and second common voltage lines connected to each storage electrode;

a common voltage generator configured to provide a common voltage to the storage electrode via the first common voltage line;

a common voltage regenerator configured to receive a voltage on the second common voltage line as a common feedback voltage, generate a common regenerative voltage via a common line according to the common feedback voltage, and provide the common regenerative voltage to the common electrode layer; and the common line located on the second substrate and electrically connected to the common electrode layer via silver paste, the common regenerative voltage being applied to the common electrode layer via the common line and the silver paste in sequence;

wherein the common line is located between a first edge of the second substrate and the first common voltage line, and between a second edge of the second substrate and the second common voltage line.

2. The liquid crystal display of claim 1, wherein the common voltage regenerator comprises a common feedback voltage input, a common voltage input, and a common regenerative voltage output, the common feedback voltage input being electrically connected to the storage electrode via the second common voltage line, the common voltage input being electrically connected to the common voltage generator, and the common regenerative voltage output being electrically connected to the common line.

3. The liquid crystal display of claim 2, wherein the common voltage regenerator further comprises an operational amplifier, a capacitor, a first resistor, and a second resistor, the common feedback voltage input being electrically connected to an inverting input of the operational amplifier via the capacitor and the first resistor, an output of the operational amplifier being electrically connected to the common regenerative voltage output, the common regenerative voltage output being also electrically connected to the inverting input of the operational amplifier via the second resistor, and the common voltage input being electrically connected to a non-inverting input of the operative amplifier.

4. The liquid crystal display of claim 1, wherein the common feedback voltage received by the common voltage regenerator comprises a plurality of ripples.

5. The liquid crystal display of claim 4, wherein the common regenerative voltage generated by the common voltage regenerator comprises a plurality of ripples of phase opposite to ripples of the common feedback voltage.

6. The liquid crystal display of claim 5, wherein the ripples of the common regenerative voltage have the same amplitude as the ripples of the common feedback voltage.

7. The liquid crystal display of claim 1, wherein the common voltage provided by the common voltage generator is a 5v direct current voltage.

8. The liquid crystal display of claim 1, wherein the common line is formed along four sides of the second substrate of the liquid crystal panel.

9. The liquid crystal display of claim 8, wherein the common line is divided into four sections corresponding to the four sides of the second substrate of the liquid crystal panel, and the liquid crystal display further comprises three common voltage regenerators, which, together with the original common voltage regenerator, are configured to provide common regenerative voltages to the four sections of the common line.

10. The liquid crystal display of claim 9, wherein the common regenerative voltages provided by the four common voltage regenerators are different from each other.

11. The liquid crystal display of claim 1, wherein the first and second common voltage lines are parallel to the data lines.

12. A method for driving a liquid crystal display, the liquid crystal display comprising a liquid crystal panel, a common voltage generator, and a common voltage regenerator, the liquid crystal panel comprising a first substrate including a common electrode layer formed thereon, a second substrate opposite to the first substrate, and a liquid crystal layer sandwiched between the first and second substrates, a plurality of data lines and a plurality of gate lines provided on the second substrate and crossing each other to define a plurality of pixel units, each pixel unit comprising a liquid crystal capacitor and a storage capacitor, each liquid crystal capacitor comprising a pixel electrode for receiving gradation voltages applied by a corresponding one of the data lines, the common electrode layer opposite to the pixel electrode, and the liquid crystal layer sandwiched therebetween, and each storage capacitor comprising the pixel electrode, a storage electrode opposite to the pixel electrode, and an insulating material sandwiched therebetween, wherein the liquid crystal panel further comprises a first common voltage line and a second common voltage line formed at two opposite sides of the second substrate for sandwiching the plurality of pixel units, both of the first and second common voltage lines connected to each storage electrode, the method comprising:

the common voltage generator providing a common voltage to the storage electrode via the first common line;

the common voltage regenerator receiving a voltage on the second common line as a common feedback voltage;

the common voltage regenerator generating a common regenerative voltage via a common line according to the common feedback voltage, and providing the common regenerative voltage to the common electrode layer; and the common line via which the common voltage regenerator provides the common regenerative voltage to the common electrode layer is connected electrically to the common electrode layer via silver paste, the common regenerative voltage comprising ripples; wherein the common line is located between a first edge of the second substrate and the first common voltage line, and between a second edge of the second substrate and the second common voltage line.

13. The method of claim 12, wherein the common feedback voltage-comprises ripples.

14. The method of claim 12, wherein the ripples of the common regenerative voltage have a phase opposite to, and amplitude the same as, ripples of the common feedback voltage.

15. A liquid crystal display comprising: a liquid crystal panel comprising:

a first substrate;

a second substrate opposite to the first substrate;

a liquid crystal layer sandwiched between the first and second substrates;

a plurality of data lines parallel to each other along a first direction;

a plurality of gate lines parallel to each other along a second direction perpendicular to the first direction, thereby defines an array including a plurality of rows and a plurality of columns; a plurality of conductive lines parallel to the gate lines;

a plurality of common electrodes and a plurality of storage electrodes, the storage electrodes at each row rows connected to a same conductive line; and a first common voltage line and a second common voltage line formed at two opposite sides of the second substrate for sandwiching the array, the first common voltage line connected to one end of the plurality of conductive lines, and the second common voltage line connected to the other end of the plurality of connective lines;

a common voltage generator configured to provide a common voltage to the storage electrode via the first common voltage line and the conductive lines;

a common voltage regenerator connected to the second common voltage line and configured to receive a voltage on the second common voltage line as a common feedback voltage, generate a common regenerative voltage via a common line according to the common feedback voltage, and provide the common regenerative voltage to the common electrode; and the common line via which the common voltage generator is connected electrically to the common electrode is connected electrically to the common electrode layer via silver paste;

wherein the common line is located between a first edge of the second substrate and the first common voltage line, and between a second edge of the second substrate and the second common voltage line.

16. The liquid crystal display of claim 15, wherein the common feedback voltage and the common regenerative voltage each have ripples, the ripples of the common regenerative voltage having a phase opposite to the ripples of the common feedback voltage, and amplitude the same as the ripples of the common feedback voltage.

* * * * *